US008789770B2

(12) United States Patent
Johnson

(10) Patent No.: US 8,789,770 B2
(45) Date of Patent: Jul. 29, 2014

(54) TOOLESS NEEDLE CHANGE SPRAY GUN

(75) Inventor: Daniel R. Johnson, Champlin, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 651 days.

(21) Appl. No.: 13/140,311

(22) PCT Filed: Dec. 14, 2009

(86) PCT No.: PCT/US2009/067911

§ 371 (c)(1),
(2), (4) Date: Jun. 16, 2011

(87) PCT Pub. No.: WO2010/080365

PCT Pub. Date: Jul. 15, 2010

(65) Prior Publication Data

US 2011/0248100 A1 Oct. 13, 2011

Related U.S. Application Data

(60) Provisional application No. 61/138,769, filed on Dec. 18, 2008.

(51) Int. Cl.

| | |
|---|---|
| ***B05B 7/02*** | (2006.01) |
| *B05B 9/01* | (2006.01) |
| *B05B 12/00* | (2006.01) |

(52) U.S. Cl.

CPC ... *B05B 7/02* (2013.01); *B05B 9/01* (2013.01); *B05B 12/002* (2013.01)

USPC ..... 239/526; 239/600; 239/583

(58) Field of Classification Search

CPC ..... B05B 15/02; B05B 1/3046; B05B 9/01; B05B 12/002; B05B 7/002

USPC ..... 239/525–528, 583, 600

See application file for complete search history.

(56) References Cited

U.S. PATENT DOCUMENTS

| | | | | |
|---|---|---|---|---|
| 3,380,705 | A | 4/1968 | Enssel | |
| 3,459,374 | A | 8/1969 | Probst | |
| 3,670,967 | A | 6/1972 | Fahlin et al. | |
| 3,780,953 | A | 12/1973 | Malec | |
| 3,913,844 | A | 10/1975 | Petrovic | |
| 4,676,437 | A | 6/1987 | Brown | |
| 4,993,642 | A | 2/1991 | Huffgard | |
| 5,609,302 | A | 3/1997 | Smith | |
| 5,699,967 | A | 12/1997 | Conatser et al. | |
| 5,829,680 | A | 11/1998 | Perret, Jr. | |
| 6,152,386 | A * | 11/2000 | Bullock et al. | 239/525 |
| 8,439,281 | B2 * | 5/2013 | Troudt | 239/526 |
| 2011/0121103 | A1 * | 5/2011 | Carleton et al. | 239/337 |

FOREIGN PATENT DOCUMENTS

| | | |
|---|---|---|
| EP | 0 572 237 A1 | 12/1993 |

* cited by examiner

*Primary Examiner* — Jason Boekmann

(74) *Attorney, Agent, or Firm* — Douglas B. Farrow

(57) ABSTRACT

A slide pin assembly is introduced in HVLP and other spray guns allowing the needle/trigger actuation to be engaged and disengaged. Furthermore, the fluid nozzle is knurled to provide for effortless removal. The construction of this gun consists of a slide pin, trigger, needle and fluid nozzle. The trigger has keyhole apertures that interact with the diameter of the cross-action slide-pin.

2 Claims, 3 Drawing Sheets

TOOLESS NEEDLE CHANGE SPRAY GUN

TECHNICAL FIELD

This application claims the benefit of U.S. application Ser. No. 61/138,769, filed Dec. 18, 2008, the contents of which are hereby incorporated by reference.

BACKGROUND ART

Contractors using an HVLP turbine spray gun are constantly changing their fluid needles and nozzles out of the gun.

DISCLOSURE OF THE INVENTION

Due to the high frequency of change out in HVLP and other spray guns, users need a simple, tool-less way to change their fluid needles and nozzles out of the gun without risking air passage and seal contamination. To accomplish this, a slide pin assembly is introduced allowing the needle/trigger actuation to be engaged and disengaged. Furthermore, the fluid nozzle has been knurled to provide for effortless removal.

The construction of this gun consists of a slide pin, trigger, needle and fluid nozzle. The trigger has keyhole shaped features that interact with the diameter of the cross-action slide-pin. When the slide pin is in the spray position, the larger diameter of the slide-pin is positioned in the larger diameter of the trigger keyhole feature. When the slide-pin is pushed perpendicular to the orientation of the gun, to the removal position, the smaller diameter of the slide-pin allows the smaller diameter of the trigger keyhole feature to drop down, thereby disengaging the actuation of the fluid needle.

This assembly entirely eliminates the possibility of fluids contaminating air passages and seals. While the industry standard prior art designs almost ensure this contamination. Knurling the nozzle of this assembly will allow users to assemble this component without tools. This design completely eliminates any need to remove the trigger or use any tools for cleaning or change of the needle and nozzle.

These and other objects and advantages of the invention will appear more fully from the following description made in conjunction with the accompanying drawings wherein like reference characters refer to the same or similar parts throughout the several views.

BEST MODE FOR CARRYING OUT THE INVENTION

Figure 1:
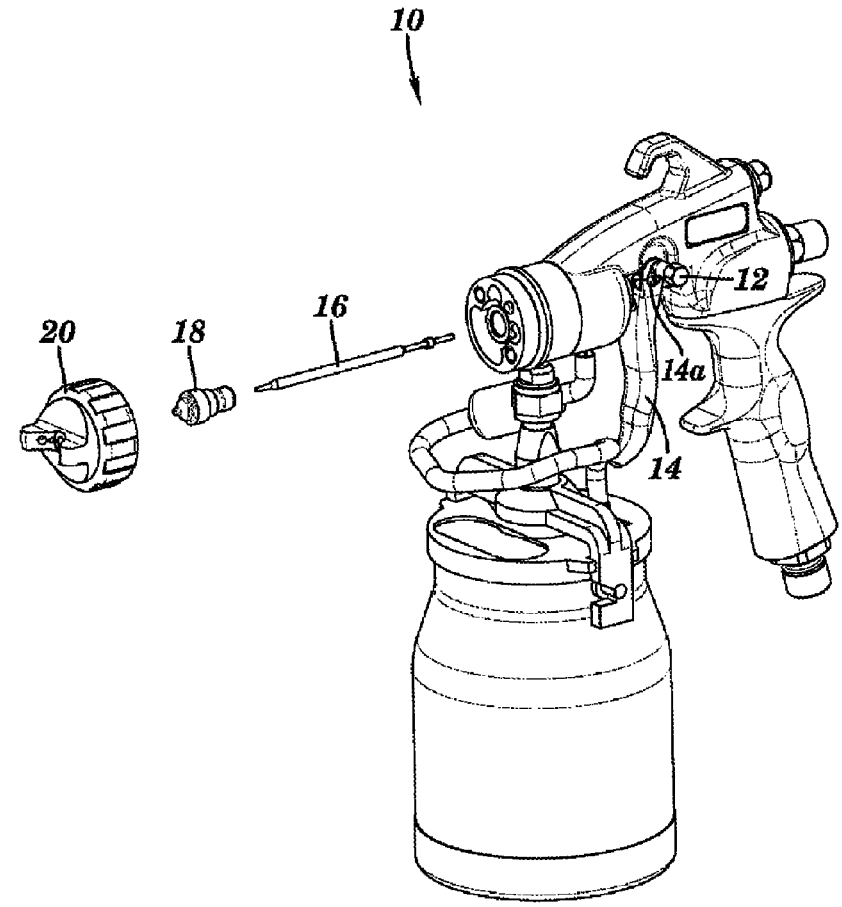
FIG. 1 shows an exploded view of the front end of a spray gun utilizing the instant invention.
Figure 2B:
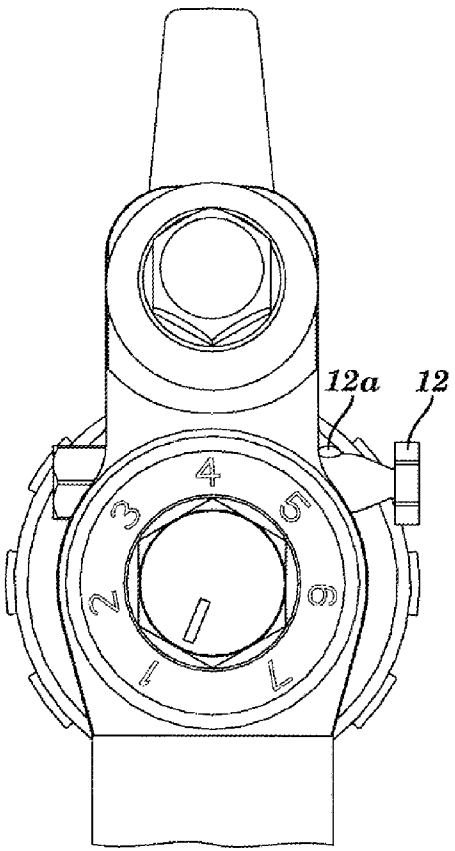
FIG. 2*b* shows the trigger slide in the spray position.
Figure 2A:
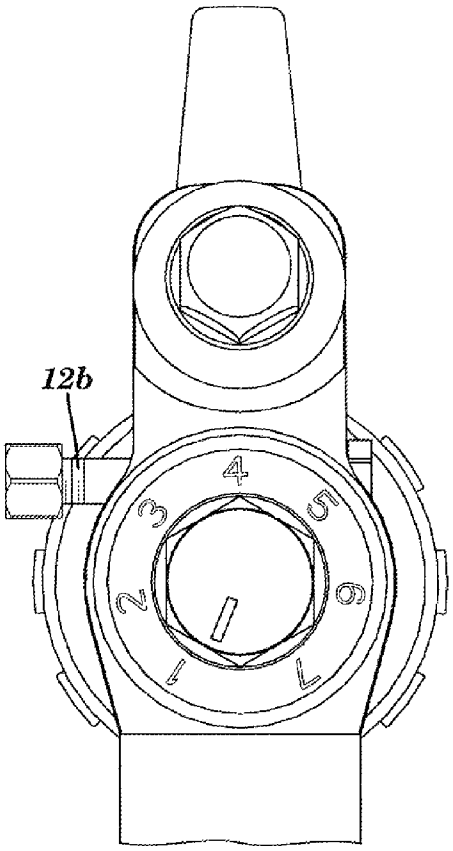
FIG. 2*a* shows the trigger slide in the needle removal position.
Figure 4:
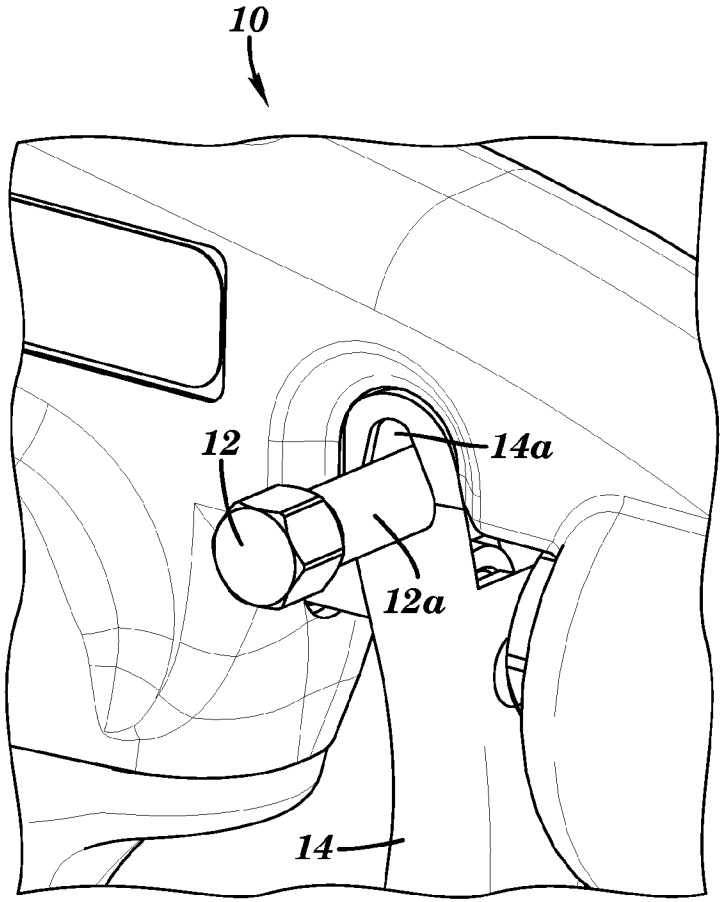
FIG. 4 shows the trigger slide in the spray position.
Figure 3:
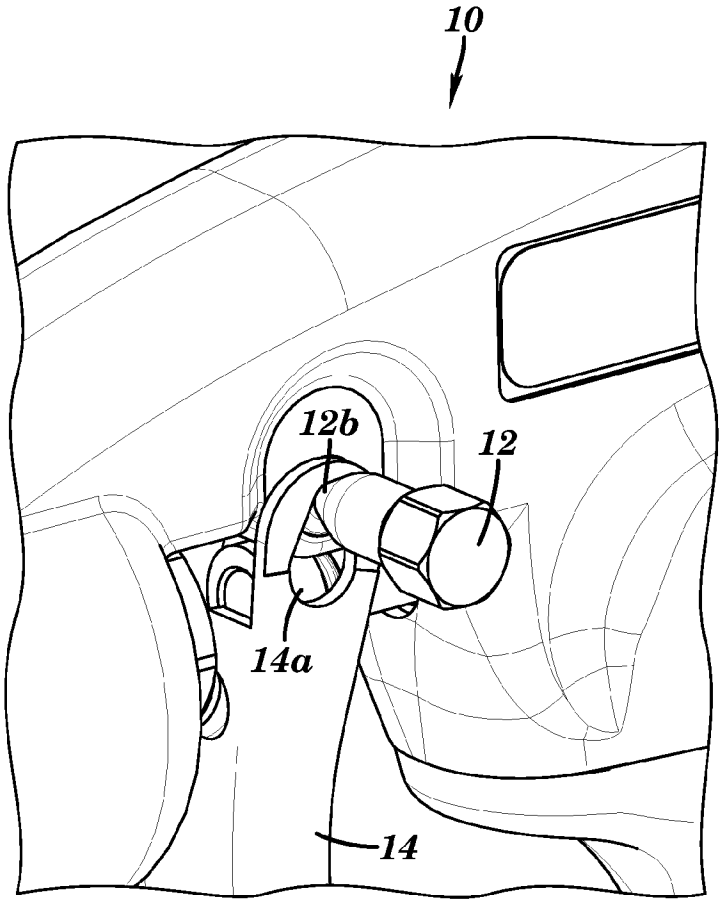
FIG. 3 shows the trigger slide in the needle removal position.

The construction of this gun 10 consists of a trigger slide pin 12, trigger 14, needle 16, fluid nozzle 18 and air cap 20. The trigger 14 has keyhole shaped apertures 14*a* that interact with the diameter of the cross-action slide-pin 12. When the slide pin 12 is in the spray position, the larger diameter 12*a* of the slide-pin 12 is positioned in the larger diameter of the trigger keyhole aperture 14*a* (FIGS. 2*b* and 4). When the slide-pin 12 is pushed perpendicular to the orientation of the gun 10, to the removal position, the smaller diameter 12*b* of the slide-pin 12 allows the smaller diameter of the trigger keyhole aperture 14*a* to drop down, thereby disengaging the actuation of the fluid needle 16 (FIGS. 2*a* and 3).

Knurling the nozzle 18 of this assembly will allow users to assemble this component without tools. This design completely eliminates any need to remove the trigger 14 or use any tools for cleaning or change of the needle 16 and nozzle 18.

It is contemplated that various changes and modifications may be made to the spray gun without departing from the spirit and scope of the invention as defined by the following claims.

The invention claimed is:

1. In a spray gun having a trigger, a needle and a fluid nozzle, the improvement comprising:

at least one keyhole shaped feature in said trigger, said keyhole feature comprising a larger diameter portion and a smaller diameter portion; and a slide-pin for releasably engaging said trigger and said needle and moveable between a spray position and a removal position, said slide-pin having a larger diameter portion and a reduced diameter portion whereby when said slide-pin is in said spray position, said larger diameter of said slide-pin is positioned in said larger diameter of said trigger keyhole feature and when said slide-pin is pushed perpendicular to said needle to said removal position, said smaller diameter of said slide-pin allows said smaller diameter of said trigger keyhole feature to drop down, thereby disengaging the actuation of said fluid needle.

2. The spray gun of claim 1 wherein said fluid nozzle is knurled.

* * * * *